US008251232B2

(12) United States Patent
Nakaya et al.

(10) Patent No.: US 8,251,232 B2
(45) Date of Patent: Aug. 28, 2012

(54) ARTICLE ADVANCING DEVICE AND ARTICLE ARRANGEMENT SHELF

(75) Inventors: Kazunori Nakaya, Tokyo (JP); Koichi Yamazaki, Tokyo (JP); Hiroyuki Ono, Tokyo (JP); Tatsuo Arakawa, Tokyo (JP)

(73) Assignees: Sekisui Plastics Co., Ltd., Osaka (JP); Arakawa Kinzoku Co. Ltd., Tokyo (JP)

( * ) Notice: Subject to any disclaimer, the term of this patent is extended or adjusted under 35 U.S.C. 154(b) by 27 days.

(21) Appl. No.: 12/955,142

(22) Filed: Nov. 29, 2010

(65) Prior Publication Data

US 2011/0127287 A1 Jun. 2, 2011

(30) Foreign Application Priority Data

Dec. 1, 2009 (JP) ..... 2009-273658

(51) Int. Cl.
*A47F 1/04* (2006.01)
*B65H 75/34* (2006.01)
*B65H 75/48* (2006.01)

(52) U.S. Cl. ..... 211/59.2; 242/388.6

(58) Field of Classification Search ..... 211/59.3, 211/51, 175, 59.2; 312/61, 71, 91, 97, 35, 312/42, 45; 221/279, 280, 53, 227; 414/278; 242/388, 388.1, 388.6, 388.7
See application file for complete search history.

(56) References Cited

U.S. PATENT DOCUMENTS 2,726,825 A * 12/1955 Ziskin et al. ..... 242/594.5
3,132,782 A * 5/1964 Coates, Jr. ..... 225/23
3,132,784 A * 5/1964 Cohen et al. ..... 225/37
3,166,195 A * 1/1965 Taber ..... 211/59.4
3,730,327 A * 5/1973 Lieberman ..... 198/751
3,830,198 A * 8/1974 Boone ..... 118/506
3,837,595 A * 9/1974 Boone ..... 242/594.5
3,848,745 A * 11/1974 Smith ..... 211/59.3
4,042,096 A * 8/1977 Smith ..... 211/85.18
(Continued)

FOREIGN PATENT DOCUMENTS

JP 7-143927 6/1995
(Continued)

OTHER PUBLICATIONS

U.S. Appl. No. 12/994,587 to Tatsuo Arakawa et al., filed Nov. 24, 2010.

*Primary Examiner* — Darnell Jayne
*Assistant Examiner* — Kimberley S Wright
(74) *Attorney, Agent, or Firm* — Greenblum & Bernstein, P.L.C.

(57) ABSTRACT

An article advancing device and an article arrangement shelf with simple structures can be securely operated without electric power. The article advancing device includes elongated drawer members with flexible band-shaped sheets and stopper structures disposed at distal ends of the flexible band-shaped sheets to allow articles to be arranged on the elongated drawer members when pulled-out, rollers for fixing proximal ends of the band-shaped sheets in position and winding up the band-shaped sheets by predetermined driving force while allowing the band-shaped sheets to be freely pulled out, and a main body for housing the rollers and the wound up band-shaped sheets. The rollers are disposed in parallel to each other within the main body, and the elongated drawer members are disposed on the rollers respectively so as not to overlap each other in a width direction.

14 Claims, 9 Drawing Sheets

U.S. PATENT DOCUMENTS

| | | | | | |
|---|---|---|---|---|---|
| 4,238,022 | A | * | 12/1980 | Williams | 193/32 |
| 4,303,162 | A | * | 12/1981 | Suttles | 211/59.3 |
| 4,351,439 | A | * | 9/1982 | Taylor | 211/59.3 |
| 4,729,481 | A | * | 3/1988 | Hawkinson et al. | 211/59.3 |
| 4,742,936 | A | * | 5/1988 | Rein | 221/5 |
| 4,750,743 | A | * | 6/1988 | Nicoletti | 273/148 A |
| 4,762,259 | A | * | 8/1988 | Kosa | 225/37 |
| 5,027,957 | A | * | 7/1991 | Skalski | 211/59.3 |
| 5,161,702 | A | * | 11/1992 | Skalski | 211/59.3 |
| 5,190,186 | A | * | 3/1993 | Yablans et al. | 221/124 |
| 5,240,126 | A | * | 8/1993 | Foster et al. | 211/59.3 |
| 5,605,237 | A | * | 2/1997 | Richardson et al. | 211/59.3 |
| 5,671,851 | A | * | 9/1997 | Johnson et al. | 211/51 |
| 5,873,489 | A | * | 2/1999 | Ide et al. | 221/279 |
| 5,944,233 | A | * | 8/1999 | Bourne | 222/272 |
| 6,105,791 | A | * | 8/2000 | Chalson et al. | 211/59.3 |
| 6,109,458 | A | * | 8/2000 | Walsh et al. | 211/59.3 |
| 6,464,089 | B1 | * | 10/2002 | Rankin, VI | 211/59.3 |
| 6,523,703 | B1 | * | 2/2003 | Robertson | 211/59.3 |
| 6,655,536 | B2 | * | 12/2003 | Jo et al. | 211/59.3 |
| 6,820,754 | B2 | * | 11/2004 | Ondrasik | 211/59.3 |
| 7,497,342 | B2 | * | 3/2009 | Hardy | 211/59.3 |
| 7,506,769 | B2 | * | 3/2009 | Howerton et al. | 211/59.3 |
| 7,641,072 | B1 | * | 1/2010 | Vlastakis et al. | 221/123 |
| 7,665,612 | B2 | * | 2/2010 | Turner | 206/575 |
| 7,766,187 | B2 | * | 8/2010 | Schaefers | 221/54 |
| 7,926,668 | B2 | * | 4/2011 | Barkdoll | 211/59.3 |
| 2004/0140279 | A1 | * | 7/2004 | Mueller et al. | 211/59.3 |
| 2010/0089847 | A1 | * | 4/2010 | Rataiczak et al. | 211/59.3 |
| 2011/0079605 | A1 | * | 4/2011 | Arakawa et al. | 221/253 |
| 2011/0215129 | A1 | * | 9/2011 | McGuigan | 225/91 |

FOREIGN PATENT DOCUMENTS

| | | | | |
|---|---|---|---|---|
| JP | 2003-267520 | | | 9/2003 |
| JP | 2005-110741 | | | 4/2005 |
| JP | 2007-82779 | | | 4/2007 |
| JP | 2011147715 | A | * | 8/2011 |
| WO | 2007/020725 | | | 2/2007 |
| WO | WO 2009145160 | A1 | * | 12/2009 |

* cited by examiner

ARTICLE ADVANCING DEVICE AND ARTICLE ARRANGEMENT SHELF

FIELD OF THE INVENTION

The present invention relates to an article advancing device and an article arrangement shelf, which allows a row of articles arranged in a depth direction of the article advancing device to be shifted forwardly when the forwardmost article is taken out.

RELATED ART

Hitherto, a variety of types of product arrangement shelves are known, which allow a row of products arranged in a depth direction thereon to be shifted forward to a space, which space being caused by taking out the foremost product. For example, Patent Document 1 discloses a belt-conveyor type product display shelf that shifts forward a row of arranged products by rotation of an endless belt, and a roller-conveyor type product display shelf that allows a row of products to be disposed at an inclined angle and shifted forward by their own weight. Patent Document 2 discloses a slide-type product display shelf that has an inclined shelf board having a highly slippable top surface, allowing a row of products to be shifted forward by their own weight. Patent Document 3 discloses a push-type product display shelf that shifts forward a row of products by a biasing force of a spring. Furthermore, Patent Documents 4 and 5 disclose a push-type product display shelf that shifts forward a row of products by a restoring force of a band-shaped body (a band-shaped tape or a band shaped steel plate).

PRIOR ART DOCUMENTS

Patent Documents

Patent Document 1: Japanese Patent Application Laid-open No. Hei-7-143927

Patent Document 2: Japanese Patent Application Laid-open No. 2007-82779

Patent Document 3: Japanese Patent Application Laid-open No. 2003-267520

Patent Document 4: Japanese Patent Application Laid-open No. 2005-110741

Patent Document 5: PCT International Application Publication No. WO2007/20725

DISCLOSURE OF THE INVENTION

Problems to be Solved by the Invention

The belt conveyor-type product display shelf of Patent Document 1, however, causes high manufacturing costs and running costs, since it uses a motor as a driving force to rotate the endless belt and hence requires an electric power. Although the roller conveyor-type product display shelf of Patent Document 1, the slide-type product display shelf of Patent Document 2 and the like can suppress manufacturing costs and running costs because they each do not use a motor, the products may not be shifted forward when the rollers are not sufficiently rotated or the shelf board is not sufficiently slippy. The product display shelves of Patent Documents 3-5, each using, as a driving force, the biasing force of a spring and the restoring force of a band-shaped body, can suppress manufacturing costs and running costs because they each also do not use a motor; however necessitate a complicated mechanism to appropriately control the biasing force or restoring force, posing a problem of increasing the manufacturing costs.

In consideration of the above problem, it is an object of the present invention to provide an article advancing device and an article arrangement shelf that can be securely operated with a simple structure while not requiring electric power.

Means for Solving Problems

In order to solve the above problems, according to the present invention, there is provided an article advancing device, which allows a row of articles arranged in a depth direction of the article advancing device to be shifted forward when the forwardmost article is taken out, including: an elongated drawer member that includes a flexible band-shaped sheet and a stopper structure disposed at a distal end of the flexible band-shaped sheet, and is structured to allow articles to be arranged thereon when the elongated drawer member is held at a pulled-out position; a roller for fixing a proximal end of the band-shaped sheet in position and winding up the band-shaped sheet by a predetermined driving force while allowing the same to be freely pulled out; and a main body for housing the roller and the wound up band-shaped sheet, wherein the roller is provided in plural and disposed in parallel to each other within the main body, and the elongated drawer member and another elongated drawer member are disposed on the rollers respectively so as not to overlap each other in a width direction.

According to another aspect of the present invention, there is provided an article arrangement shelf including a plurality of article advancing devices disposed side by side along the front side of a shelf board, each of the article advancing devices allowing a row of articles arranged in a depth direction of the article advancing device to be shifted forward when the forwardmost article is taken out, including: an elongated drawer member that includes a flexible band-shaped sheet and a stopper structure disposed at a distal end of the flexible band-shaped sheet, and is structured to allow articles to be arranged thereon when the elongated drawer member is held at a pulled-out position; a roller for fixing a proximal end of the band-shaped sheet in position and winding up the band-shaped sheet by a predetermined driving force while allowing the same to be freely pulled out; and a main body for housing the roller and the wound up band-shaped sheet, wherein the roller is provided in plural and disposed in parallel to each other within the main body, and the elongated drawer member and another elongated drawer member are disposed on the rollers respectively so as not to overlap each other in a width direction.

According to the above structure, when in use, each of the elongated drawer member is pulled out and articles are arranged thereon. The stopper structure, which moves forward along with the movement in a winding-up direction of the band-shaped sheet, shifts a row of the articles forward and makes the same into abutment with the main body, thereby stopping the further winding-up of the band-shaped sheet and keeping this position. When the forwardmost article is taken out, an unoccupied space is caused between the main body and the articles. The elongated drawer member shifts forward by a distance equal to the size of the taken-out article to close up this unoccupied space, and along with this, a row of the remaining articles is shifted forward. Thus, a row of the articles is at any time held close to the forward side and therefore an article can be at any time taken out from the forwardmost side.

In the present invention, plural sets each including the elongated drawer member and a roller for winding up the band-shaped sheet of the elongated drawer member are provided, and mechanisms each for biasing a force of the winding-up direction against the band-shaped sheet are independently of each other provided to the rollers, so that, even if there is a difference in the number of arranged articles between the one elongated drawer member and the other elongated drawer member, it is possible to make the article advancing functions work independently of each other.

The article advancing device of the present invention preferably further includes driving force adjustment mechanisms provided respectively to the rollers so as to each adjust the driving force of each of the rollers.

According to the above structure, devices each for adjusting the force of the winding-up direction biased against the band-shaped sheet (driving force adjustment device) are independently of each other provided to the rollers, so that it is possible to make the article advancing functions work independently of each other with appropriate forces for the respective elongated drawer members.

In the article advancing device of the present invention, the plural rollers may be disposed at vertically displaced positions with a spacing therebetween.

According to the above structure having the rollers disposed at the vertically displaced positions, it is possible to reduce the size in the depth direction, so that, even if the rollers are arranged on the forward side of an article display shelf, they are unlikely to be noticeable and therefore causes no feeling of strangeness. As a result, it is possible to achieve harmonized design in entire appearance of the article display shelf.

In the article advancing device of the present invention, an opening having an elongated width may be provided in a back surface of the main body so that each of the band-shaped sheets is pulled outward through the opening.

According to the above structure, it is possible to set the height, at which each of the band-shaped sheets is pulled outward from the main body, at the same height.

Advantages of the Invention

As described above, according to the present invention, by providing the flexible band-shaped sheet having the stopper structure at its distal end; the elongated drawer member that allows articles to be arranged thereon when it is held at a pulled-out position; the roller that winds up the band-shaped sheet while allowing the same to be freely pulled out; and the main body that houses the roller and the wound-up band-shaped sheet, it is possible to provide an article advancing device and an article arrangement shelf that can securely operate with a simple structure, while not requiring electric power.

DETAILED DESCRIPTION OF THE PREFERRED EMBODIMENT

Figure 1:
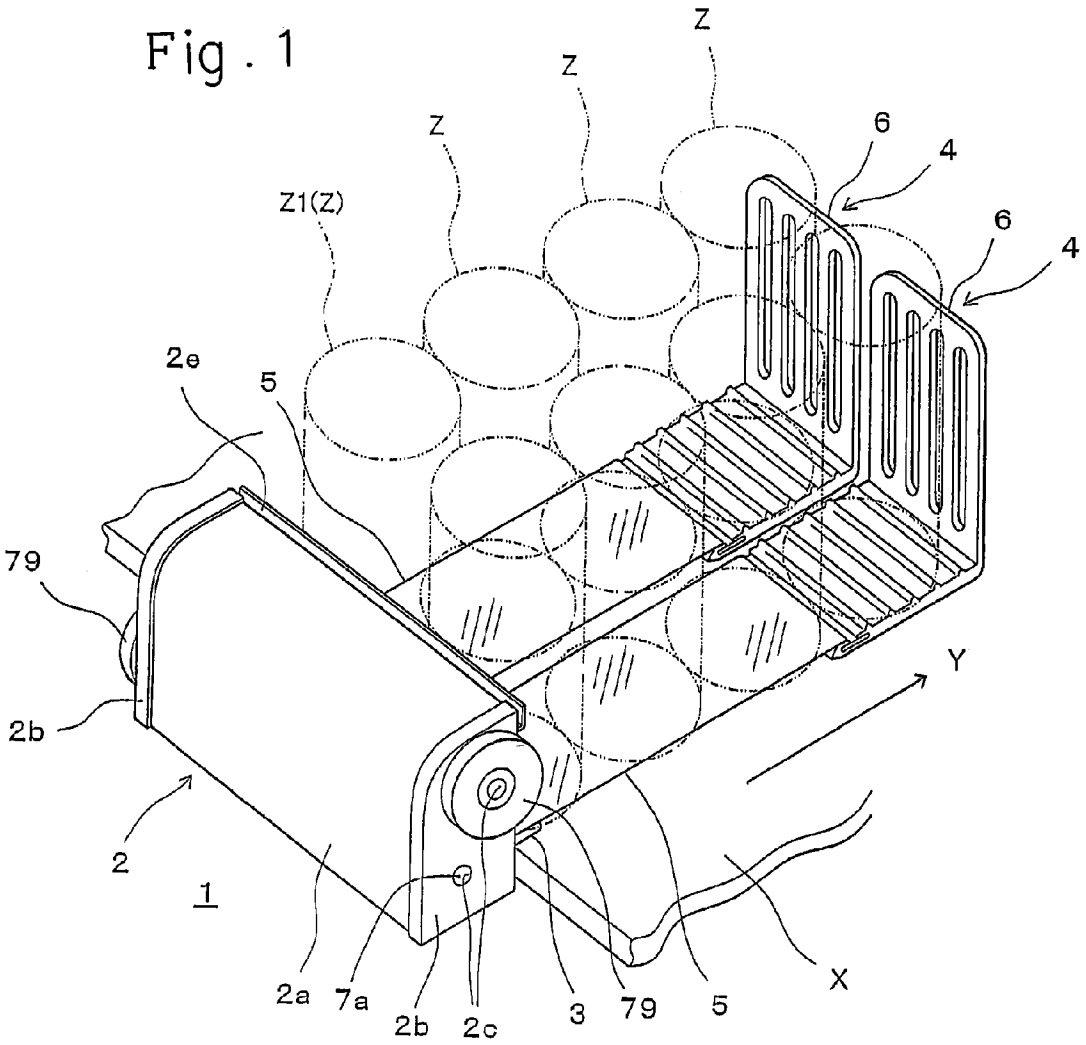
FIG. 1 is a perspective view showing the state, in which an article arrangement shelf has been formed by mounting an article advancing device of this embodiment to the front end edge of a shelf board.
Figure 2:
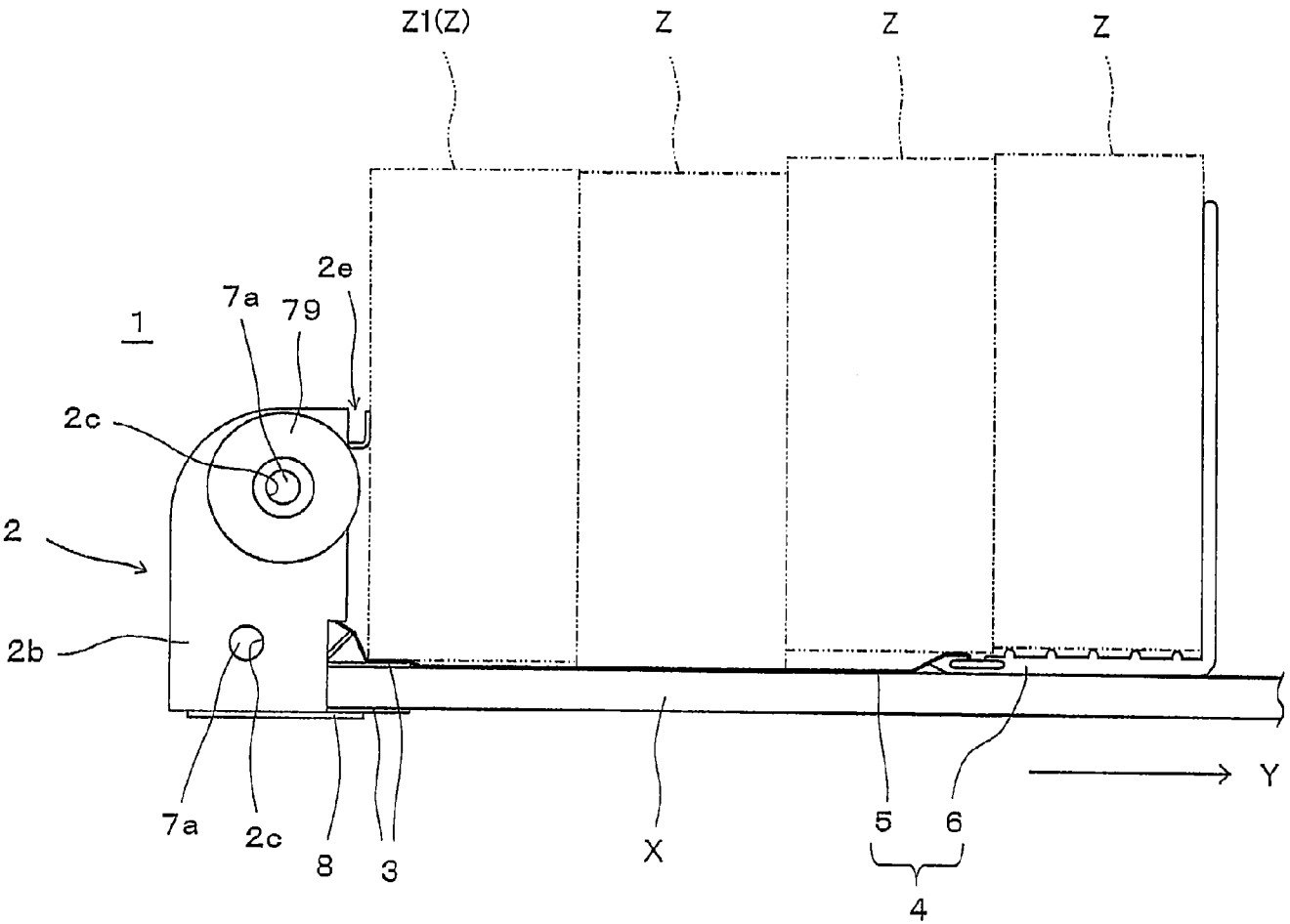
FIG. 2 is a side view thereof.

Now, the description will be made for an embodiment of an article advancing device and an article arrangement shelf of the present invention with reference to the attached drawings. FIG. 1 is a perspective view showing the state, in which an article arrangement shelf has been formed by mounting an article advancing device 1 of this embodiment to the front end edge of a shelf board X. FIG. 2 is a side view thereof. As shown in FIGS. 1 and 2, the article advancing device 1 is detachably mounted to the shelf board X via a mounting portion 3 (specifically, via its front end edge) having a clamping structure, and is structured so that, when a forwardmost article Z1 among the articles Z, . . . arranged in a depth direction Y is taken out, a row of the remaining articles Y, . . . is shifted forward. A plurality of the article advancing devices 1 are disposed side by side along the front side of the shelf board X (only one of them is shown in FIG. 1), and all of them together constitute an article arrangement shelf.

More specifically, each of elongated drawer members 4, in which a stopper member 6 is attached to a distal end of each of flexible band-shaped sheets 5, are disposed on the shelf board X, and are pulled outward in the depth direction Y from the main body 2, and a plurality of articles Z, . . . are arranged in a row in the depth direction Y on each of the elongated drawer members 4. Although more detailed description will be made later, rollers each for winding up the band-shaped sheet 5 are disposed within the main body 2, and a driving device that utilizes, as a driving force, the biasing force of a spring made up of a coil spring biased against each of the rollers is disposed, so that a force in such a direction as to wind up each of the band-shaped sheets 5 into the main body 2 is constantly applied to each of the band-shaped sheets 5. Thus, the stopper member 6, which moves forward along with the movement of each of the band-shaped sheets 5 in the winding-up direction, shifts a row of the articles Z, . . . forward, and upon abutment of the foremost article Z1 against the main body 2, each of the band-shaped sheets 5 is stopped from being wound up further, and this state is kept unchanged. When the foremost article Z1 is taken out, an unoccupied space is caused between the main body 2 and the articles Z, . . . . Each of the elongated drawer members 4 is shifted forward by a distance equal to the size of the taken-out article Z1 in order to close up this unoccupied space, and along with this, a row of the remaining articles Z, . . . is shifted forward. Thus, the row of the articles Z, . . . are held in such a state to be constantly drawn toward the forward side, so that the articles can be taken out from the forwardmost side. In FIGS. 1 and 2, four articles Z are present for every row for the convenience in drafting the Figures, and therefore each of the elongated drawer members 4 has such a length as to be able to dispose more articles Z, . . . when in actual use.

Here, as shown in FIG. 1, a pair of right and left elongated drawer members 4 are provided and specifically comprised of the right elongated drawer member 4 that is housed in the right half of the main body 2 in the width direction so as to be extended and retracted, and the left elongated drawer member 4 that is housed in the left half of the main body 2 in the width direction so as to be extended and retracted. The respective elongated drawer members 4 are positioned in parallel to each other with a slight clearance in the width direction therebetween when they are pulled outward onto the shelf board X, and these members are used independently of each other to each have the articles Z, . . . arranged thereon in the depth direction Y.

Figure 3:
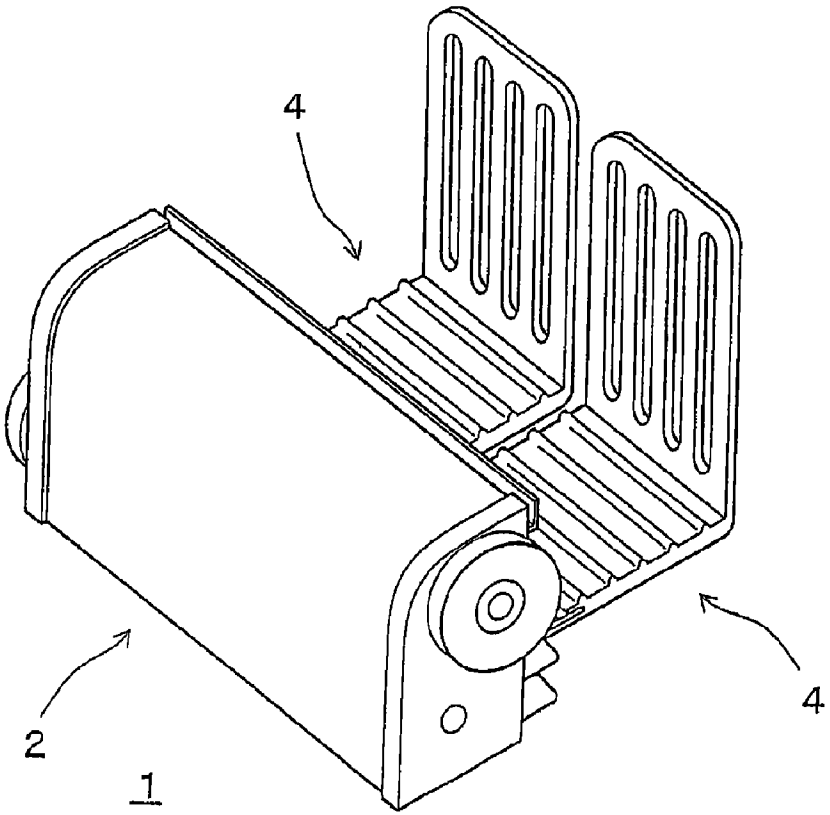
FIG. 3 is a perspective view showing the product advancing device having a pair of band-shaped sheets wound up and housed within a main body.
Figure 4:
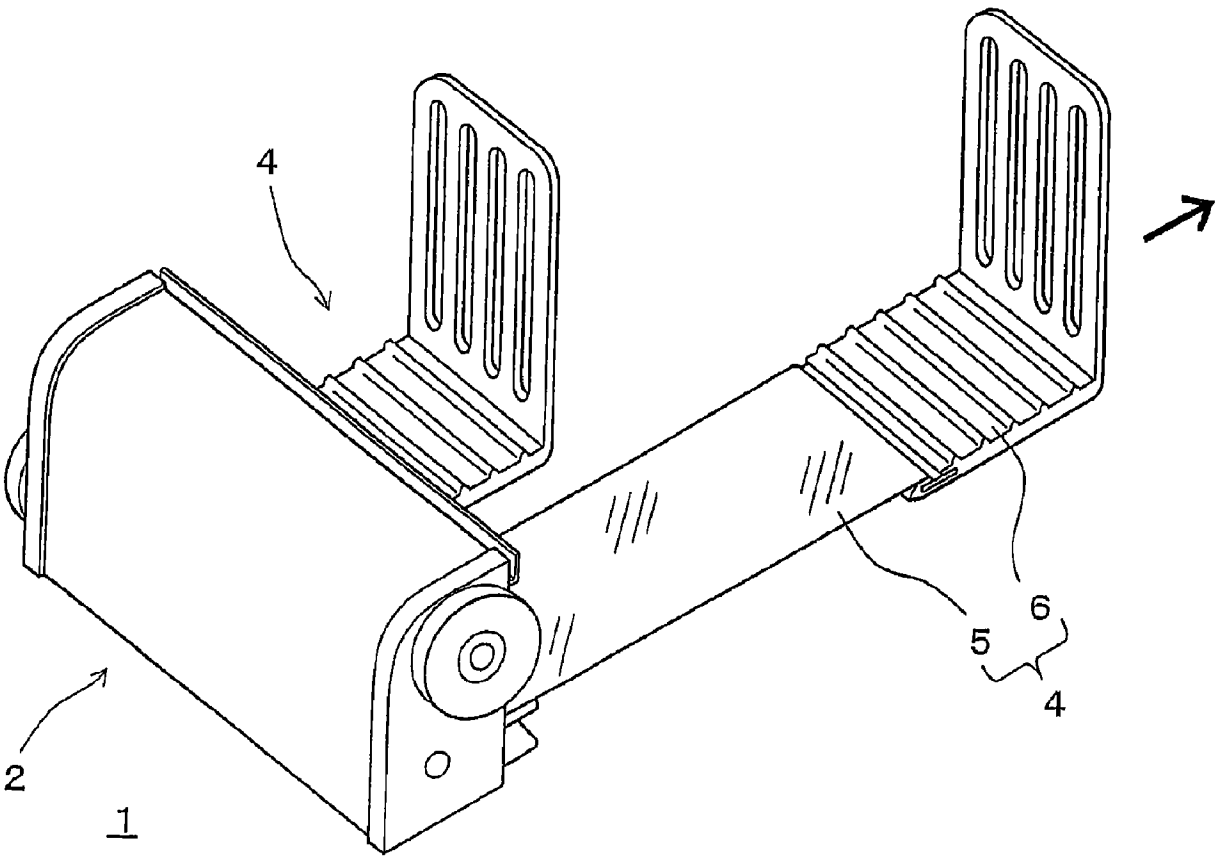
FIG. 4 is a perspective view showing the article advancing device having one of the pair of band-shaped sheets pulled out.
Figure 5:
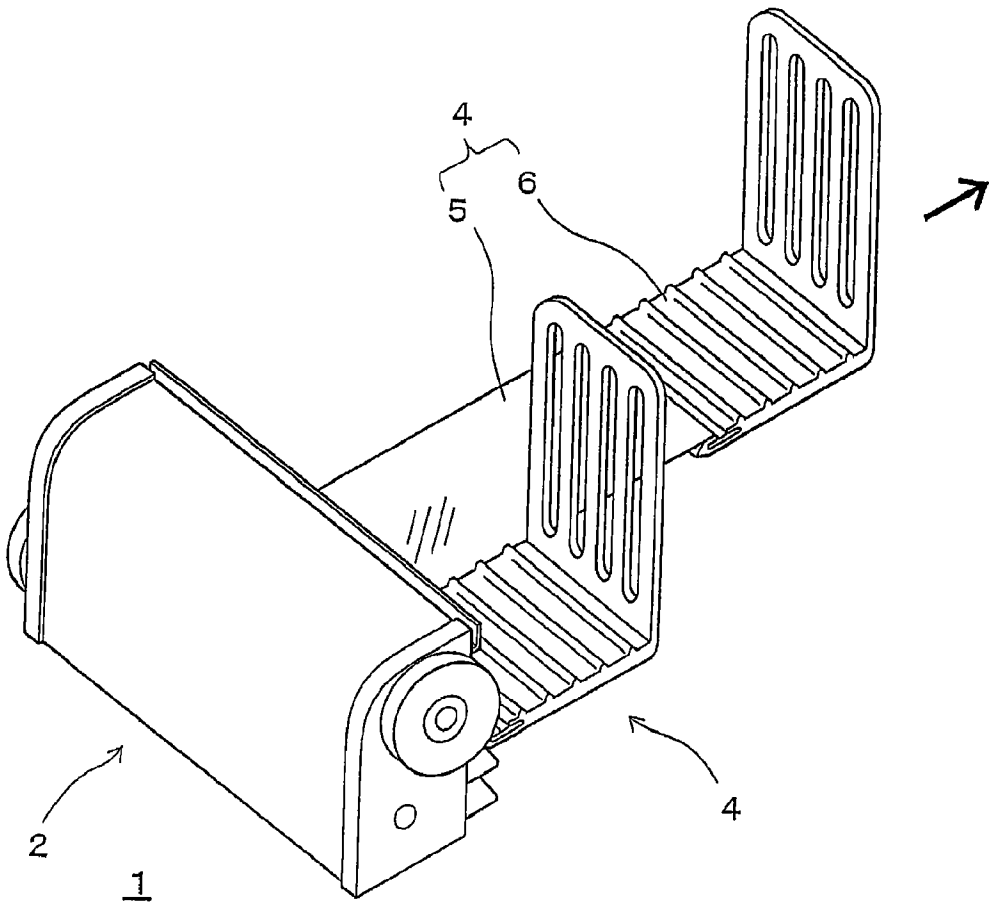
FIG. 5 is a perspective view showing the article advancing device having the other one of the pair of band-shaped sheets pulled out.

That is, the article advancing device 1 is structured so as to be shifted from the state shown in FIG. 3, in which no articles Z are placed on each of the elongated drawer members 4 and therefore the band-shaped sheets 5 are completely wound up, causing the stopper members 6 to be most closely brought to the main body 2, for example, to the state shown in FIG. 4, in which only the right elongated drawer member 4 is pulled out, or to the state shown in FIG. 5, in which only the left elongated drawer member 4 is pulled out.

The band-shaped sheets 5 are not necessarily limited in material, but a material, such as Teflon (registered trademark) having flexibility, which is easy to be wound up, or other materials with Teflon coated thereon. In a case where food products are arranged on the article arrangement shelf, it is preferable to use a material having a bactericidal effect and a bacteria resistance (e.g., polyester, such as PET).

Figure 6:
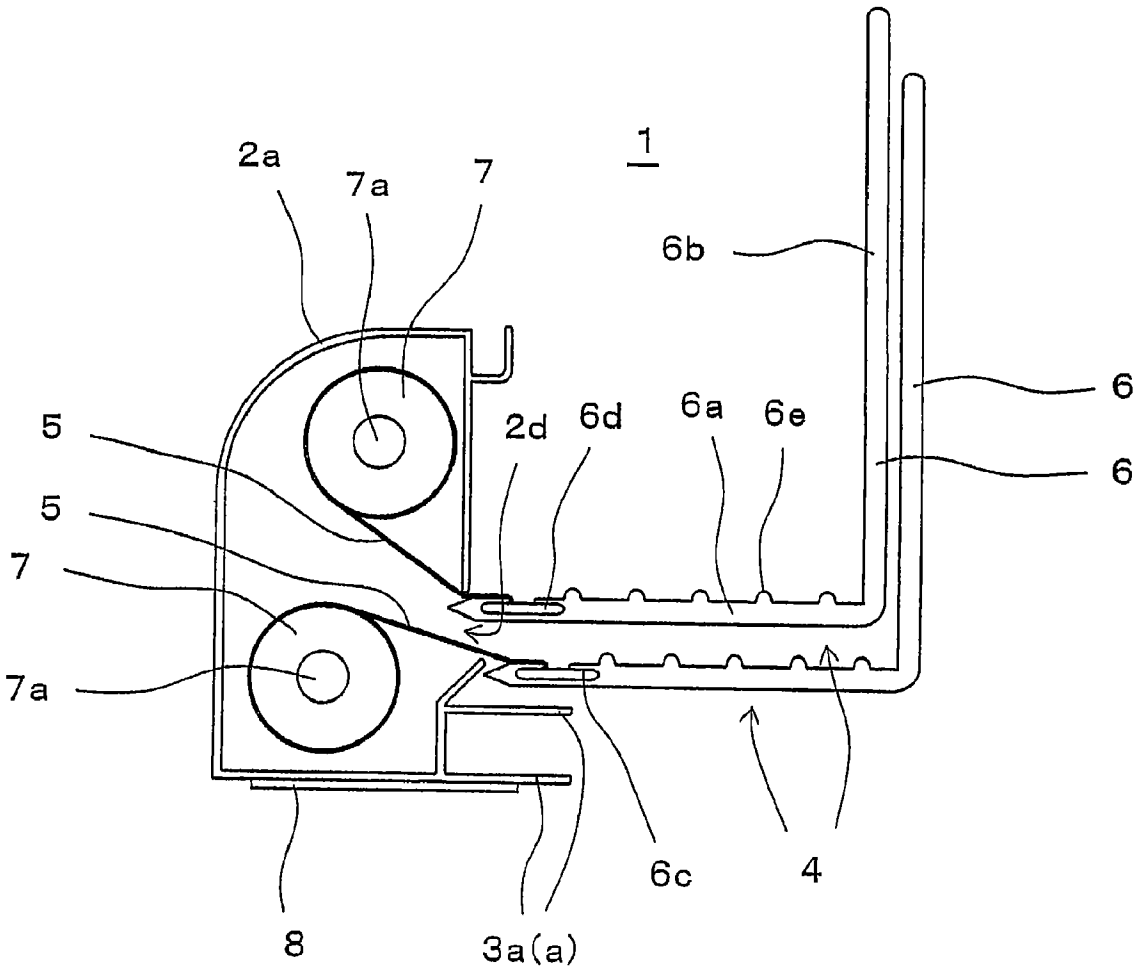
FIG. 6 is a cross sectional side view of the article advancing device.

FIG. 6 is a vertically cross sectional view (cross sectional side view) of the article advancing device 1 taking along in the vertical direction. As shown in FIGS. 1, 2 and 6, the main body 2 includes a housing 2*a* having a tubular shape in the width direction and covers 2*b* that are fitted into openings at the opposite ends of the housing 2*a* to cover the same, respectively. The housing 2*a* is, for example, an aluminium die cast product, which is formed by extrusion casting in the widthwise direction, and the covers 2*b* are resin molded products and are mounted to the housing 2*a* by bringing screws, which extend through holes (not shown) formed in the covers 2*b*, into internal threads (not shown) of the housing 2*a*.

A pair of the covers 2*b*, 2*b* which are oriented in parallel to each other when mounted to the housing 2*a* have shaft holes 2*c*, through which a shaft part 7*a* of a roller 7 that winds up the band-shaped sheet 5 of the right elongated drawer member 4 while allowing the band-shaped sheet 5 to be freely pulled out, and a shaft part 7*a* of a roller 7 that winds up the band-shaped sheet 5 of the left elongated drawer member 4 while allowing the band-shaped sheet 5 to be freely pulled out, are mounted so that the respective rollers 7 are rotatably supported. The shaft parts 7*a* project from the end surfaces of the rollers 7 in the axial direction.

The shaft holes 2*c* are formed in pair on the upper side and the lower side, of each of the covers 2*b*, so that the pair of rollers 7, 7 are disposed in parallel to each other at vertically displaced positions within the main body 2. The upper and lower rollers 7, 7 have an identical structure and are disposed so that one of them has the right and left sides oriented opposite to those of the other one. The right elongated drawer member 4 is wound up onto the right half section of the one roller 7 (e.g., the upper roller 7), and the band-shaped sheet 5 of the left elongated drawer member 4 is wound up onto the left half section of the other roller 7 (e.g., the lower roller 7). Thus, the pair of rollers 7, 7 are wound up at such positions as not to have the band-shaped sheet 5 of the one elongated drawer member 4 overlapping to the band-shaped sheet 5 of the other elongated drawer member 4, so that the one elongated drawer member 4 and the other elongated drawer member 4 do not intervene with each other.

Figure 7:
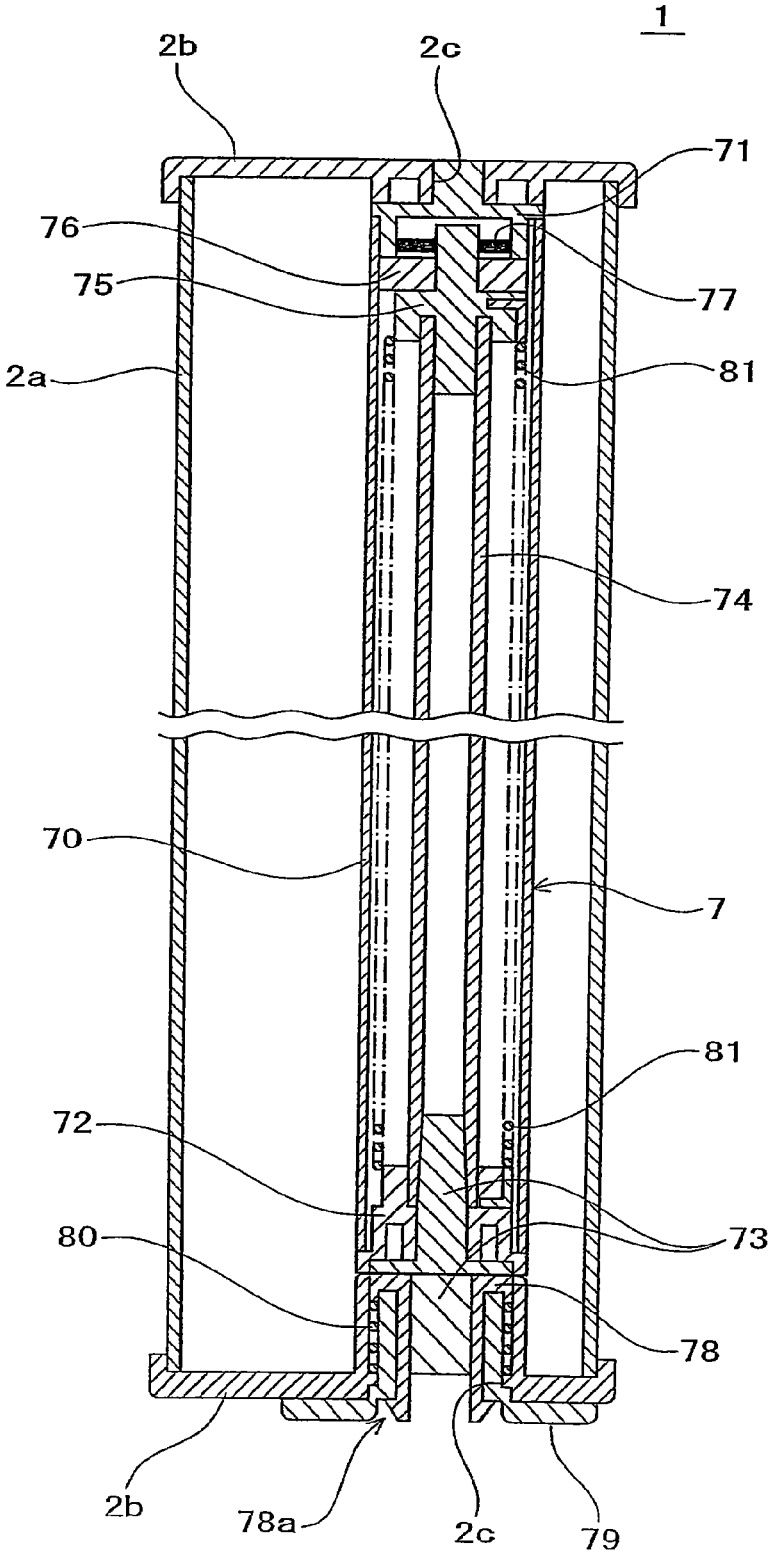
FIG. 7 is a cross sectional plan view of the article advancing device.

Now, the description will be made for the detailed structure of the rollers 7. FIG. 7 is a lateral cross sectional view (cross sectional plan view) of the article advancing device 1 taken along the lateral direction thereof. As shown in FIG. 7, the band-shaped sheet 5 has a proximal end connected to a roller pipe 70. A roller end 71, which is provided at one end of the roller pipe 70 in the axial direction, is rotatably supported to the cover 2*b* (while being inserted through the shaft hole 2*c* of the cover 2*b*), and on the other hand, a rotator 72, which is provided at the opposite end of the roller pipe 70 in the axial direction, is rotatably supported to a stator 73. The stator 73 is assembled integrally with an inner pipe 74 and a pillow 75. The pillow 75 is rotatably supported to the roller end 71 via a washer 76 and a push nut 77.

The stator 73 forms a fittingly engaging structure having a non-circular cross sectional shape (an angular cross sectional shape in this embodiment) between a shaft holder 78 and a driving-force adjustment dial 79, and is rotatable integrally with the shaft holder 78 and the driving-force adjustment dial 79 when in rotation. The driving-force adjustment dial 79 is rotatably supported to the cover 2*b* (while being inserted through the shaft hole 2*c* of the cover 2*b*). However, in a normal operation, the driving-force adjustment dial 79 is fixed to the cover 2*b* by a biasing force of a latching spring 80, which force being transmitted via a claw portion 78*a* of the shaft holder 78, and therefore is structured so as not to be rotated unless a strong force is applied.

Furthermore, as a driving device for rotating the roller pipe 70, a drive spring 81 is provided on the inner circumferential side of the roller pipe 70. One end of the drive spring 81 is connected to the rotator 72, and the other end of the drive spring 81 is connected to the pillow 75 assembled integrally with the stator 73. Accordingly, the driving force caused to the roller 7 by the drive spring 81 is generated by the relative torsion between the rotator 72 and the stator 73.

The above description on the roller 7 is applicable to any of the upper roller 7 and the lower roller 7. However, in order to prevent intervention between the driving-force adjustment dials 79, 79, which occurs in an arrangement with both the driving-force adjustment dials 79, 79 disposed at one of the covers 2*b*, or in other words, in order to prevent increase in vertical size of the main body 2 to prevent such intervention, the one roller 7 is rotated 180 degrees relative to the other roller 7 so as to have the right and left sides opposite to those of the other roller 7, so that one driving-force adjustment dial 79 is disposed on one cover 2*b* and another driving-force adjustment dial 79 (cf. FIG. 1) is disposed on the other cover 2*b* (cf. FIG. 1).

Returning to FIG. 6, the winding-up direction of the band-shaped sheet 5 of the one elongated drawer member 4 is opposite to the winding-up direction of the band-shaped sheet 5 of the other elongated drawer member 4. More specifically, both the winding-up directions are such directions as to allow the direction (tangential direction of the roller 7) in which the band-shaped sheet 5 is separated away from the roller 7 to become parallel to the arranging direction (depth direction Y) of the articles Z, . . . , as much as possible. More specifically, in the upper roller 7, the band-shaped sheet 5 is wound up in the clockwise direction, and in the lower roller 7, the band-shaped sheet 5 is wound up in the anti-clockwise direction, thereby allowing both the band-shaped sheets 5 to pass through between the rollers 7, 7.

A housing 2*a* of the main body 2 has an opening 2*d* which opens toward the depth direction Y, and the band-shaped sheets 5 passing through between the rollers 7, 7 are pulled out of the main body 2 through the opening 2*d*. The opening 2*d* is formed by extrusion molding in a case where the housing 2*a* is formed by extrusion molding, and has an elongated width. Edges of the upper and lower ends of the opening 2*d* each have a smooth rounded shape so as not to scratch the band-shaped sheets 5 even they contact or frictionally contact these edges.

The opening 2*d* is formed at a position facing between the rollers 7, 7 on the back side of the main body 2 so as to smoothly pull out the band-shaped sheets 5 which pass through between the rollers 7, 7. However, in consideration of the fact that the band-shaped sheets 5 with the articles Z, . . . placed thereon are pressed downward toward the shelf board X, the vertical middle position of the opening 2*d* is set at a position lower than the middle position between the rollers 7, 7. The lower end of the opening 2*d* is inclined toward the depth direction Y so that, when the articles Z, . . . are arranged on the pulled-out band-shaped sheets 5, the band-shaped sheets 5 are held in contact with the edge of the lower end (cf. FIG. 2). Thus, when the band-shaped sheets 5 are completely wound up, the stopper members 6 can be prevented from intruding into the main body 2 and hence interfering with the rollers 7.

At a portion further lower than the lower end of the opening 2*d* is formed the mounting portion 3, which constitutes a clamping structure. The mounting portion 3 includes a pair of vertical projection pieces 3*a*, 3*a*. In a case where the housing 2*a* is formed by extrusion molding, these projection pieces 3*a*, 3*a* are formed by this extrusion molding, and therefore each have an elongated width. The distance between the projection pieces 3*a*, 3*a* is slightly narrower than the thickness of the shelf board X, so that the article advancing device 1 can be mounted to the shelf board X by fitting the shelf board X (especially, a front end edge thereof) into between the projection pieces 3*a*, 3*a*.

The stopper members 6 each are made up of a horizontal part 6*a* and a vertical part 6*b*. On the top surface of the horizontal part 6*a* closer to the main body 2 is formed a recess 6*c* having a reverse T-shape. A bar-shaped member 6*d* having such a cross sectional shape as to enable itself to be fitted into a horizontal section of the recess 6*c* is formed so that an end portion of the band-shaped sheet 5 is wound onto the bar-shaped member 6*d* and fitted into the recess 6*c* and thereby the band-shaped sheet 5 is integrated with the stopper member 6. Thus, the elongated drawer member 4 is formed. Projection rows 6*e* extending in the width direction are formed on the top surface of the horizontal part 6*a* with a predetermined interval mutually in the arranging direction of the articles Z, . . . .

Figure 8A:
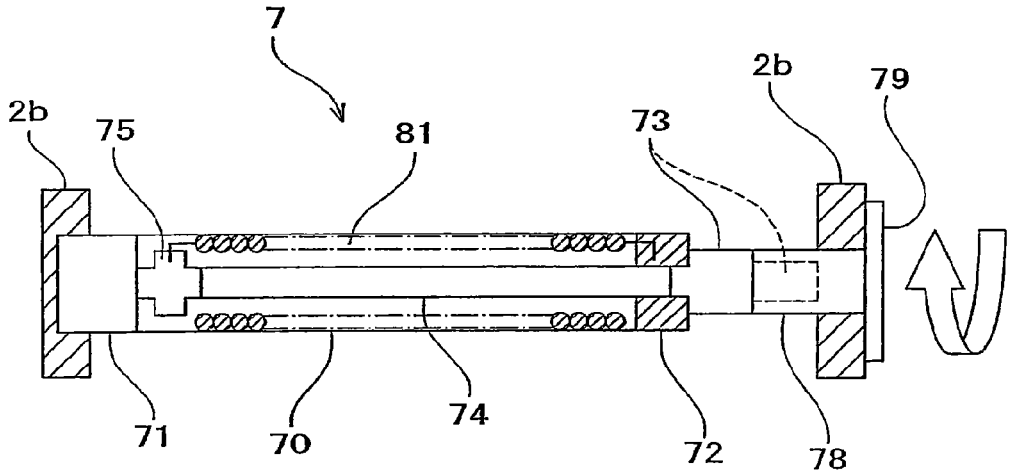
FIG. 8 show a driving force adjustment mechanism that adjusts the driving force of each roller of the article advancing device, in which FIG. 8(*a*) is an explanatory view of a schematic structure, and FIG. 8(*b*) is a schematic characteristic diagram schematically showing the principle of adjusting the driving force by the driving force adjustment mechanism.
Figure 8B:
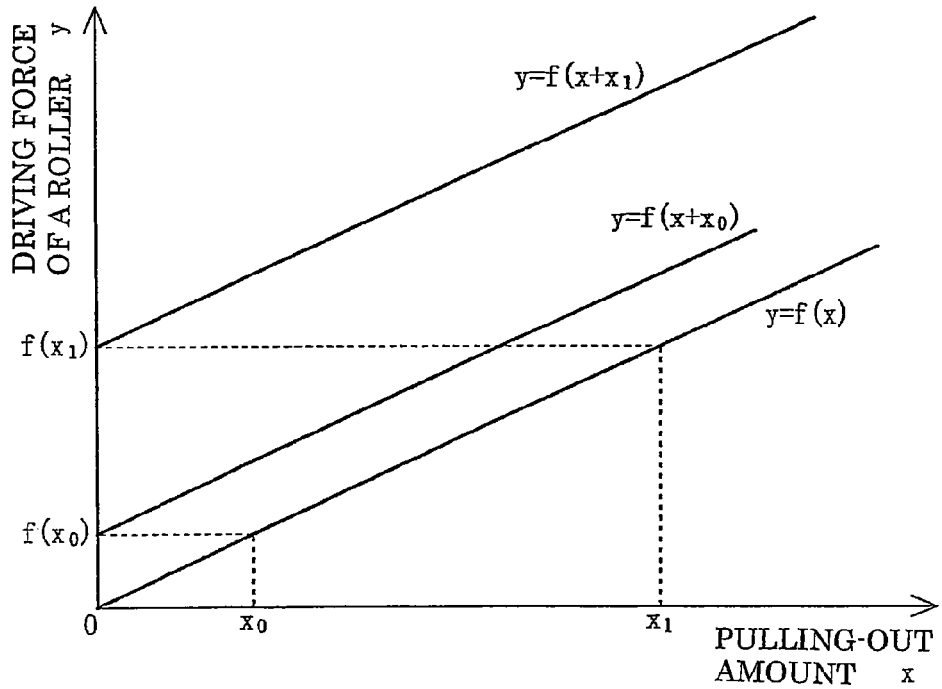

According to the structure of the article advancing device 1 described as above, now the description will be made for the adjustment method of the driving force of the roller 7. FIG. 8 show a driving force adjustment mechanism that adjusts the driving force of the roller 7 (the winding-up force of the band-shaped sheet 5), in which FIG. 8(*a*) is an explanatory view of a schematic structure, and FIG. 8(*b*) is a schematic characteristic diagram schematically showing the adjustment principle of the driving force by the driving force adjustment mechanism. Unlike FIG. 7, FIG. 8(*a*) shows the mechanism in a schematic manner. In a normal operation, the driving force adjustment dial 79 is fixed non-rotatably to the cover 2*b* by the biasing force of the latching spring 80 so that an assembled body made up of the stator 73, the inner pipe 74 and the pillow 75 is held in non-rotatable state. An assembled body made up of the roller pipe 70, the roller end 71 and the rotator 72 is rotatable, so that, when the elongated drawer member 4 is pulled outward, these members are rotated, which causes change in biasing force stored in the drive spring 81 and hence causes a force of such a direction as to wind up the band-shaped sheet 5 of the elongated drawer member 4.

Then, when the driving force adjustment dial 79 is rotated against the biasing force of the latching spring 80, the stator 73 is rotated via the shaft holder 78. Thus, the biasing state of the drive spring 81 is adjusted by rotating the stator 73, so that the driving force of the roller 7 (the winding-up force of the band-shaped sheet 5) can be adjusted.

Here, the characteristic function indicating the elastic force of the drive spring 81 is represented by y=f(x), in which x represents the puffing-out amount of the elongated drawer member 4, y represents the driving force of the roller 7. In relation with the inherent characteristics of the spring elasticity, when the length of the band-shaped sheet 5 wound up onto the roller 7 becomes maximum (X=0), y becomes minimum. However, when the minimum value of the driving force of the roller 7 is excessively small, the article advancing function may not work at the time when the number of articles Z, . . . arranged on the elongated drawer member 4 is reduced. Thus, the driving force of the roller 7 must be adjusted in order to make the article advancing function work even when x=0. For example, the minimum value of the driving force of the roller 7 can be set at f(x0) by rotating the driving force adjustment dial 79 by the number of rotations equivalent to the pulling-out amount (x0) of the elongated drawer member 4.

However, the minimum value of the driving force of the roller 7 must be adjusted appropriately according to the weight of the articles Z, . . . placed on the elongated drawer member 4, the area of base, or the like. For example, when the minimum value of the driving force of the roller 7 is set at f(x0) for a certain article Z, and the subject article has been changed to an article having a larger weight, the minimum value of the driving force of the roller 7 must be reset to a larger value, for example, f(x1). In such a case, the driving force adjustment dial 79 is further rotated to bring itself from the original state (relational expression: y=f(x)) into a state where it is rotated by the number of rotations equivalent to the puffing-out amount x1 of the elongated drawer member 4, so that the driving force can be readjusted. Thus, the driving force is adjustable so as to keep a sufficient driving force even in a state where almost all the articles Z, . . . are removed from the elongated drawer member 4.

As described above, the article advancing device 1 of this embodiment is provided with two sets of members, each set including a pair of the elongated drawer member 4 and the roller 7 for winding up the band-shaped sheet 5 of the elongated drawer member 4, and mechanisms (driving devices), each for applying to the band-shaped sheet 5 the force of such a direction as to wind up the same, which mechanisms being provided to the respective rollers 7 independently of each other. With this arrangement, when both the elongated drawer members 4 are to be used, it is possible to make the article advancing functions work independently of each other, even if there is a difference in the number of articles Z, . . . to be arranged between the right elongated drawer member 4 and the left elongated drawer member 4. In addition to this, the mechanisms for adjusting the force of the winding-up direction applied to the band-shaped sheets 5 are independently of each other provided to the respective rollers 7, so that, even if there is a difference in weight between the articles Z, . . . arranged on the right elongated drawer member 4 and the articles Z, . . . arranged on the left elongated drawer member 4, it is possible to make the article advancing functions work independently of each other.

Since the width of each of the elongated drawer members 4 is set according to the subject articles which haven a relatively small bottom area, such as canned beverages and PET bottled beverages, it is possible to reduce the size (especially reduce the width) of the article advancing device 1 of this embodiment by arranging the two article advancing functions compactly (within the single main body 2). When the article advancing device is provided with only a single article advancing function according to the subject articles having a relatively small size, the width of the article advancing device becomes wider than the width of the elongated drawer member to some extent. With this, even if plural article advancing devices are arranged tightly side by side, spaces are necessarily caused between the elongated drawer members in a direction orthogonal to the article arranging direction (or the space between the adjacent elongated drawer members in a direction orthogonal to the article arranging direction becomes necessarily greater than the width of the elongated drawer members 4, 4 of the article advancing device 1 of this embodiment), which deteriorates the storing rate of an article arrangement shelf. In this respect, the article advancing device 1 of this embodiment, in which two article advancing functions are compactly arranged, can reduce the space between the elongated drawer members 4, 4 in a direction orthogonal to the arranging direction of the articles Z, . . . , and thus the storing rate of the articles Z, . . . in each article arrangement shelf can be improved by this reduction.

The article advancing device 1 of this embodiment, in which the rollers 7, 7 are arranged at vertically displaced positions, can reduce the size in the depth direction Y, so that, even if the article advancing device 1 is disposed on the front side of an article display shelf, it is hardly noticeable and therefore causes no feeling of strangeness. As a result, it is possible to achieve harmonized design in entire appearance of the article display shelf.

The present invention is not necessarily limited to the above embodiment, and may be subjected to various modifications without departing from the scope of the present invention.

For example, in the above embodiment, two sets of the paired elongated drawer member 4 and roller 7 are provided. However, this pair is not necessarily limited to two sets, and alternatively three sets or more may be provided. When two sets are provided, the width area of the main body 2 is divided into two sections in the width direction, and each section is provided with one elongated drawer member 4. When three sets are provided, three rollers may be provided and, of them, two rollers are vertically disposed and the remaining one roller is disposed forward of them, so that the thus disposed three rollers define the apexes of a triangle in a lateral side view, respectively, and the width area of the main body 2 is divided into three sections and each section is provided with one elongated drawer member 4.

The above embodiment has a structure in which one elongated drawer member 4 is provided for one roller 7, that is, the roller 7 is provided to each of the elongated drawer member 4. Alternatively, plural rollers may be provided, and at least one roller 7 may be provided with plural elongated drawer members.

In the above embodiment, one opening 2*d* for feeding out each of the band-shaped sheets 5 to the outside of the main body 2 is commonly shared without intention to limit the present invention thereto, and an opening may be provided for every band-shaped sheet. In this case, openings each having an elongated width are provided at vertically displaced positions with distances therebetween.

In the above embodiment, each elongated drawer member 4 is designed to be pulled out in a horizontal direction relative to the horizontally oriented shelf board X. In this respect, it is possible to employ an article arranging shelf having the structure, in which an article advancing device is mounted to a shelf board inclined with a front side positioned lower, and an elongated drawer member is pulled out diagonally upward toward the depth direction.

Figure 9:
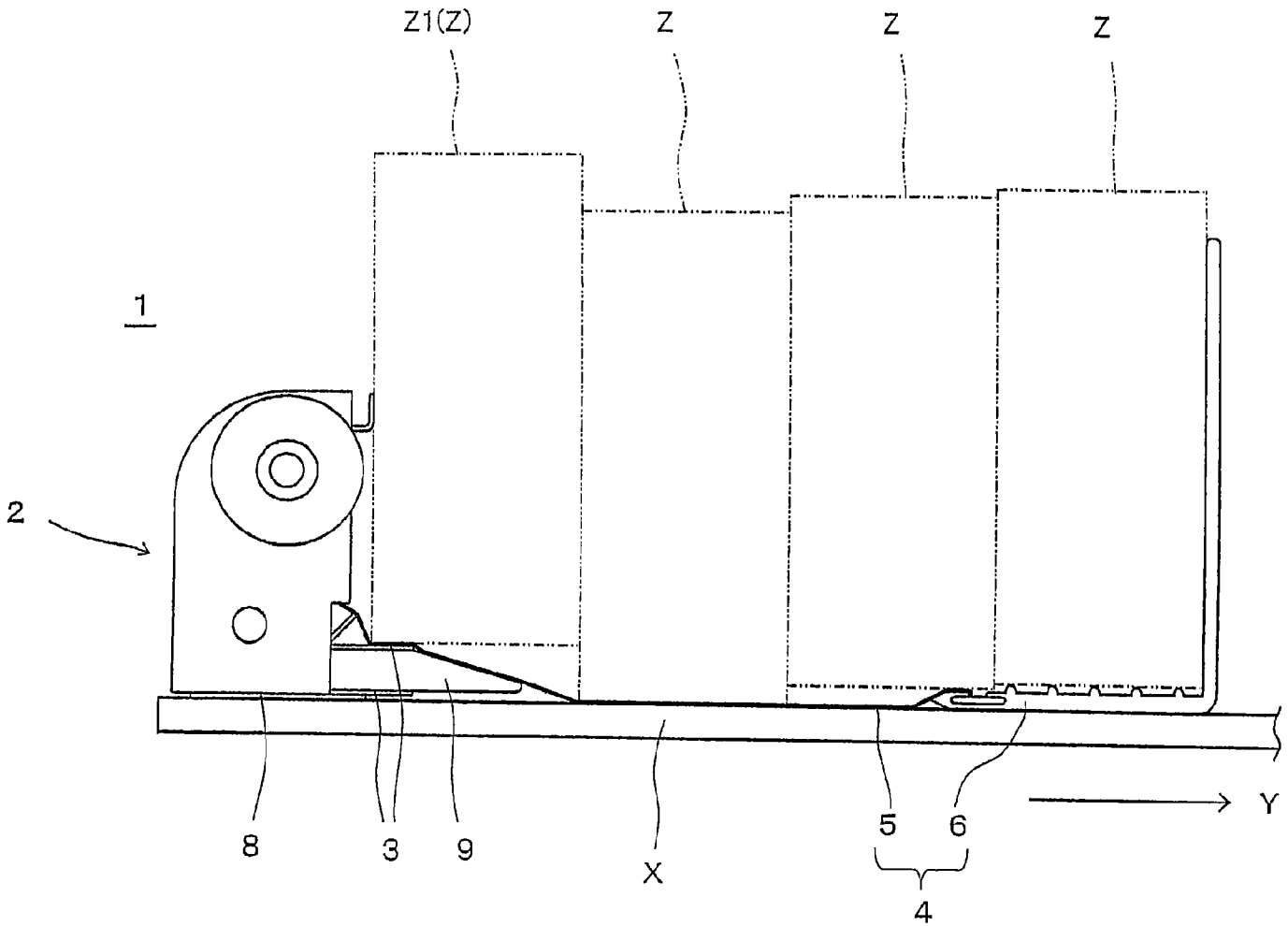
FIG. 9 is a side view showing the article advancing device, which is magnetically secured to a top surface portion of the forwardmost side of a shelf board.

In the above embodiment, the shelf board X is mounted by use of the mounting portion 3 made up of a pair of projection pieces 3*a*, 3*a*. When the shelf board X is made of a magnetic material, such as metal, a magnet (a magnetic sheet) is attached to a bottom surface of the main body 2, as shown in FIG. 9, so as to magnetically secure the article advancing device 1 to the shelf board X. In this case, it is preferable to employ an arrangement in which a slope member 9 is attached to the mounting portion 3, thereby allowing the band-shaped sheet 5 and the stopper member 6 to run up along the top surface of the slope member 9, in order to prevent the stopper member 6 from being hooked at the unused stopper member 6.

In the above embodiment, when a row of the articles Z, . . . is to be shifted forwardly, the stopper member 6 for stopping the article Z has a substantially L-shape, although this shape is not essential. In summary, the stopper member 6 may be of any shape as long as it can securely stop an article when a row of the articles is shifted forwardly to prevent an elongated drawer member from being falling out of the row of articles. Accordingly, a circular rod having an elongated width may be provided along a terminal end portion of a band-shaped sheet.

In the above embodiment, the forwardmost article Z1 abuts against the main body 2. However, in such a case where an article has a great height and may fall forward than the main body 2 and drop, a height extension plate (not shown) may be attached to a mounting portion 2*e* (cf. FIGS. 1 and 2) provided on the back side of the main body 2.

INDUSTRIAL APPLICABILITY

The present invention is suitable for a product display shelf installed in, for example, a convenience store which handles articles as products or articles for sale.

DESCRIPTION OF REFERENCE NUMERALS

1: article advancing device, 2: main body, 2*a*: housing, 2*b*: cover, 2*c*: shaft hole, 2*d*: opening, 3: mounting portion, 3*a*: projection piece, 4: elongated drawer member, 5: band-shaped sheet, 6: stopper member, 6*a*: horizontal part, 6*b*: vertical part, 6*c*: recess, 6*d*: bar-shaped member, 6*e*: projection row, 7: roller, 7*a*: shaft part, 70: roller pipe, 71: roller end, 72: rotator, 73: stator, 74: inner pipe, 75: pillow, 76: washer, 77: push nut, 78: shaft holder, 78*a*: claw portion, 79: driving-force adjustment dial, 80: latching spring, 81: drive spring, 8: magnet, 9: slope member, X: shelf board, Y: depth direction, Z: article, Z1: forwardmost article

The invention claimed is:

1. An article advancing device, which allows a row of articles arranged in a depth direction of the article advancing device to be shifted forward when the forwardmost article is taken out, comprising: a plurality of elongated drawer members, each elongated drawer member includes a flexible band-shaped sheet and a stopper structure disposed at a distal end of the flexible band-shaped sheet, and each elongated drawer member is structured to allow articles to be arranged thereon when each elongated drawer member is held at a pulled-out position; a plurality of rollers for fixing a proximal end of each respective flexible band-shaped sheet in position and winding up each respective flexible band-shaped sheet by a predetermined driving force while allowing the each respective flexible band-shaped sheet to be freely pulled out; a main body for housing the plurality of rollers and wound up portion of each flexible band-shaped sheet; a plurality of driving force adjustment mechanisms that are each respectively provided to each of the plurality of rollers, and that are each configured to be rotated to adjust the driving force of a corresponding one of the plurality of rollers, wherein the plurality of rollers are disposed in parallel to each other within the main body, and plurality of elongated drawer members are disposed on the rollers respectively so as not to overlap each other in a width direction, each of the plurality of rollers comprises a drive spring that is biased to enable adjustment of the driving force, a first assembly that supports one end of the drive spring and winds up the band-shaped sheet by rotation, and a second assembly that supports another end of the drive spring and rotates independently of the first assembly, each of the driving force adjustment mechanisms comprises a dial that is rotatably supported on the main body and is connected to the second assembly to rotate integrally with the second assembly, and a latching spring that biases the dial against the main body, and each of the driving force mechanisms is configured to prevent adjustment of the driving force when the dial is biased against the main body by the biasing force of the latching spring, and to permit adjustment of the driving force when the dial is spaced from the main body against the biasing force of the latching spring.

2. The article advancing device according to claim 1, wherein the plural rollers are disposed at vertically displaced positions with a spacing therebetween.

3. The article advancing device according to claim 1, wherein an opening having an elongated width is provided in a back surface of the main body so that each of the band-shaped sheets is pulled outward through the opening.

4. An article arrangement shelf including a plurality of article advancing devices disposed side by side along a front side of a shelf board, each of the article advancing devices allowing a row of articles arranged in a depth direction of the article advancing device to be shifted forward when the forwardmost article is taken out, comprising: a plurality of elongated drawer members, each elongated drawer member includes a flexible band-shaped sheet and a stopper structure disposed at a distal end of the flexible band-shaped sheet, and each elongated drawer member is structured to allow articles to be arranged thereon when each elongated drawer member is held at a pulled-out position; a plurality of rollers for fixing a proximal end of each respective flexible band-shaped sheet in position and winding up each respective flexible band-shaped sheet by a predetermined driving force while allowing the each respective flexible band-shaped sheet to be freely pulled out; a main body for housing the plurality of rollers and wound up portion of each flexible band-shaped sheet; a plurality of driving force adjustment mechanisms that are each respectively provided to each of the plurality of rollers, and that are each configured to be rotated to adjust the driving force of a corresponding one of the plurality of rollers, wherein the plurality of rollers are disposed in parallel to each other within the main body, and the plurality of elongated drawer members are disposed on the rollers respectively so as not to overlap each other in a width direction, each of the plurality of rollers comprises a drive spring that is biased to enable adjustment of the driving force, a first assembly that supports one end of the drive spring and winds up the band-shaped sheet by rotation, and a second assembly that supports another end of the drive spring and rotates independently of the first assembly, each of the driving force adjustment mechanisms comprises a dial that is rotatably supported on the main body and is connected to the second assembly to rotate integrally with the second assembly, and a latching spring that biases the dial against the main body, and each of the driving force mechanisms is configured to prevent adjustment of the driving force when the dial is biased against the main body by the biasing force of the latching spring, and to permit adjustment of the driving force when the dial is spaced from the main body against the biasing force of the latching spring.

5. The article advancing device according to claim 2, wherein an opening having an elongated width is provided in a back surface of the main body so that each of the band-shaped sheets is pulled outward through the opening.

6. The article advancing device according to claim 1, further comprising a shaft holder that connects the dial and the second assembly, wherein the shaft holder has a claw portion that engages with the dial to transmit the biasing force of the latching spring to the dial.

7. The article advancing device according to claim 6, wherein the second assembly comprises a stator that forms a fittingly engaging structure having a non-circular cross sectional shape between the shaft holder and the dial.

8. The article advancing device according to claim 2, further comprising a shaft holder that connects the dial and the second assembly, wherein the shaft holder has a claw portion that engages with the dial to transmit the biasing force of the latching spring to the dial.

9. The article advancing device according to claim 8, wherein the second assembly comprises a stator that forms a fittingly engaging structure having a non-circular cross sectional shape between the shaft holder and the dial.

10. The article advancing device according to claim 3, further comprising a shaft holder that connects the dial and the second assembly, wherein the shaft holder has a claw portion that engages with the dial to transmit the biasing force of the latching spring to the dial.

11. The article advancing device according to claim 10, wherein the second assembly comprises a stator that forms a fittingly engaging structure having a non-circular cross sectional shape between the shaft holder and the dial.

12. The article advancing device according to claim 5, further comprising a shaft holder that connects the dial and the second assembly, wherein the shaft holder has a claw portion that engages with the dial to transmit the biasing force of the latching spring to the dial.

13. The article advancing device according to claim 12, wherein the second assembly comprises a stator that forms a fittingly engaging structure having a non-circular cross sectional shape between the shaft holder and the dial.

14. The article advancing device according to claim 1, wherein a width of each flexible band-shaped sheet is less than one half of a width of the main body.

* * * * *